US007967074B2

(12) United States Patent
Lake et al.

(10) Patent No.: US 7,967,074 B2
(45) Date of Patent: Jun. 28, 2011

(54) ELECTRIC WIRELINE INSERT SAFETY VALVE

(75) Inventors: Gary B. Lake, Houston, TX (US); Richard Patterson, Houston, TX (US); Thad Andrews, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 399 days.

(21) Appl. No.: 12/181,768

(22) Filed: Jul. 29, 2008

(65) Prior Publication Data

US 2010/0025045 A1 Feb. 4, 2010

(51) Int. Cl.
*E21B 33/12* (2006.01)
*F16K 31/44* (2006.01)

(52) U.S. Cl. ..... 166/386; 166/373; 166/332.8; 166/66.6; 166/66.7; 166/332.1; 251/30.01; 251/68; 251/69; 251/71; 251/129.1

(58) Field of Classification Search ..... 166/332.8, 166/66.6, 66.7, 332.1, 66.4, 386, 373; 251/30.01, 251/68–71, 129.1
See application file for complete search history.

(56) References Cited

U.S. PATENT DOCUMENTS

| | | | | |
|---|---|---|---|---|
| 514,168 | A | 2/1894 | Telsa | |
| 649,621 | A | 5/1900 | Tesla | |
| 685,953 | A | 11/1901 | Tesla | |
| 685,954 | A | 11/1901 | Tesla | |
| 685,956 | A | 11/1901 | Tesla | |
| 685,957 | A | 11/1901 | Tesla | |
| 685,958 | A | 11/1901 | Tesla | |
| 787,412 | A | 4/1905 | Tesla | |
| 1,119,732 | A | 12/1914 | Tesla | |
| 1,990,977 | A | 2/1935 | Cawley | 250/11 |
| 2,415,688 | A | 2/1947 | Hall, Jr. | 219/25 |
| 3,781,647 | A | 12/1973 | Glaser | 322/2 |
| 4,191,248 | A * | 3/1980 | Huebsch et al. | 166/66.7 |
| 4,685,047 | A | 8/1987 | Phillips, Sr. | 363/126 |
| 5,535,828 | A * | 7/1996 | der Kinderen et al. | 166/372 |
| 6,269,874 | B1 * | 8/2001 | Rawson et al. | 166/53 |
| 6,619,388 | B2 | 9/2003 | Dietz et al. | 166/66.7 |
| 6,798,716 | B1 | 9/2004 | Charych | 367/119 |
| 6,906,495 | B2 | 6/2005 | Cheng et al. | 320/108 |
| 7,027,311 | B2 | 4/2006 | Vanderelli et al. | 363/8 |
| 2004/0173362 | A1 | 9/2004 | Waithman et al. | 166/386 |
| 2005/0230118 | A1 | 10/2005 | Noske et al. | 166/332.8 |
| 2006/0278395 | A1 * | 12/2006 | Kenison et al. | 166/312 |
| 2007/0295504 | A1 | 12/2007 | Patel | 166/263 |

* cited by examiner

*Primary Examiner* — Daniel P Stephenson
*Assistant Examiner* — Yong-Suk Ro
(74) *Attorney, Agent, or Firm* — Shawn Hunter

(57) ABSTRACT

Methods and devices for utilizing an electrically-actuated wireline insert safety valve (WLSV) within a wellbore. Power is delivered to an electrically actuated WLSV to actuate the WLSV via inductive charging and without the use of wired contact.

19 Claims, 4 Drawing Sheets

ELECTRIC WIRELINE INSERT SAFETY VALVE

BACKGROUND OF THE INVENTION

1. Field of the Invention

The invention relates generally to safety valves and devices used within a wellbore.

2. Description of the Related Art

In the oil and gas industry, subsurface safety valves are used as a means of stopping the production of hydrocarbons in the event of an unexpected catastrophe or a planned shut down of a well. Most subsurface safety valves are hydraulically controlled from the surface facility by connecting a hydraulic control line to surface pumping equipment. Application of pressure at the surface is transmitted to the safety valve to open the device. Subsurface safety valves are typically installed into the well as a part of the production tubing string. Accordingly, these safety valves are typically referred to as tubing retrievable safety valves (TRSVs). In the event that the TRSV fails or stops functioning properly, it is possible to install a smaller safety valve into the interior diameter of the existing TRSV by running the smaller valve into the production tubing on wireline. The smaller installed valve is referred to as a wireline insert safety valve (WLSV). The WLSV operates off of the hydraulic pressure of the TRSV. Before running the WLSV into the TRSV, it is necessary to create a communication chamber between the TRSV and the wellbore. Several tools or methods can be used to accomplish fluid communication with the hydraulic chamber of the TRSV. Once communication is established, the WLSV is landed into the TRSV. A set of seals located on the upper portion and the lower portion of the WLSV land above and below the TRSV. The seals prevent the hydraulic fluid from escaping into the wellbore and allow the WLSV to operate off of the hydraulic control line of the TRSV.

It is problematic to utilize a wireline insert safety valve where the TRSV uses electrical power rather than hydraulic power to be actuated. There is no mechanism for transmitting hydraulic power to the wireline insert valve. In addition, if the WLSV is electrically powered, it is difficult to transmit electrical power to the WLSV in a reliable manner. Downhole environments are filled with debris and are extremely corrosive environments. Solids can build up on exposed areas of a downhole valve, including electrical contacts. An electrical plug or port for electrically mating the TRSV and WLSV would likely become exposed and filled with debris to make an electrical connection difficult, if not impossible.

SUMMARY OF THE INVENTION

The invention provides methods and devices for utilizing an electrically-actuated wireline insert safety valve and for delivering power to an electrically actuated WLSV without the use of wired contact. In a preferred embodiment, inductive charging is used to deliver actuating power from a TRSV to a WLSV. There are preferably no exposed metallic contacts to corrode, and the electronic compartments are preferably sealed to prevent water corrosion or physical damage from debris within the wellbore.

In a described embodiment, an electrically-powered tubing-run safety valve is provided with an induction charging coil that is sealed within the valve housing. A wireline-run insert safety valve is also provided with an induction charging coil that is operably interconnected with a valve actuator assembly that is operable to cause a safety valve member, such as a flapper member, to be operated within the safety valve.

In an aspect of the present invention, the WLSV may be selectively inserted into the production tubing string which carries the TRSV. The WLSV is preferably landed within a landing profile associated with the TRSV. When landed, the induction charging coils of the TRSV and WLSV become substantially aligned to form an inductive coupling. Energizing the induction charging coil of the TRSV will transmit electrical energy to the coil of the WLSV. The transmitted electrical energy is used to actuate the WLSV valve actuator assembly and safety valve. In an alternative embodiment, the transmitted electrical energy is preferably stored within a charge storage device in the WLSV, and the stored electrical energy is thereafter used to actuate the WLSV valve actuator assembly and safety valve.

In certain embodiments, the WLSV may be actuated from the surface by a wireless signal to a wireless receiver that is operably interconnected with the WLSV valve actuator assembly. In this instance, the wireless transmitted will command the WLSV to remain in the open position, and the WLSV valve member will move from the closed position to the open position. Thereafter, current supplied to the WLSV from the induction charging coil in the TRSV will retain the WLSV in the open position. The WLSV can be closed by deenergizing the induction charging coil in the TRSV.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
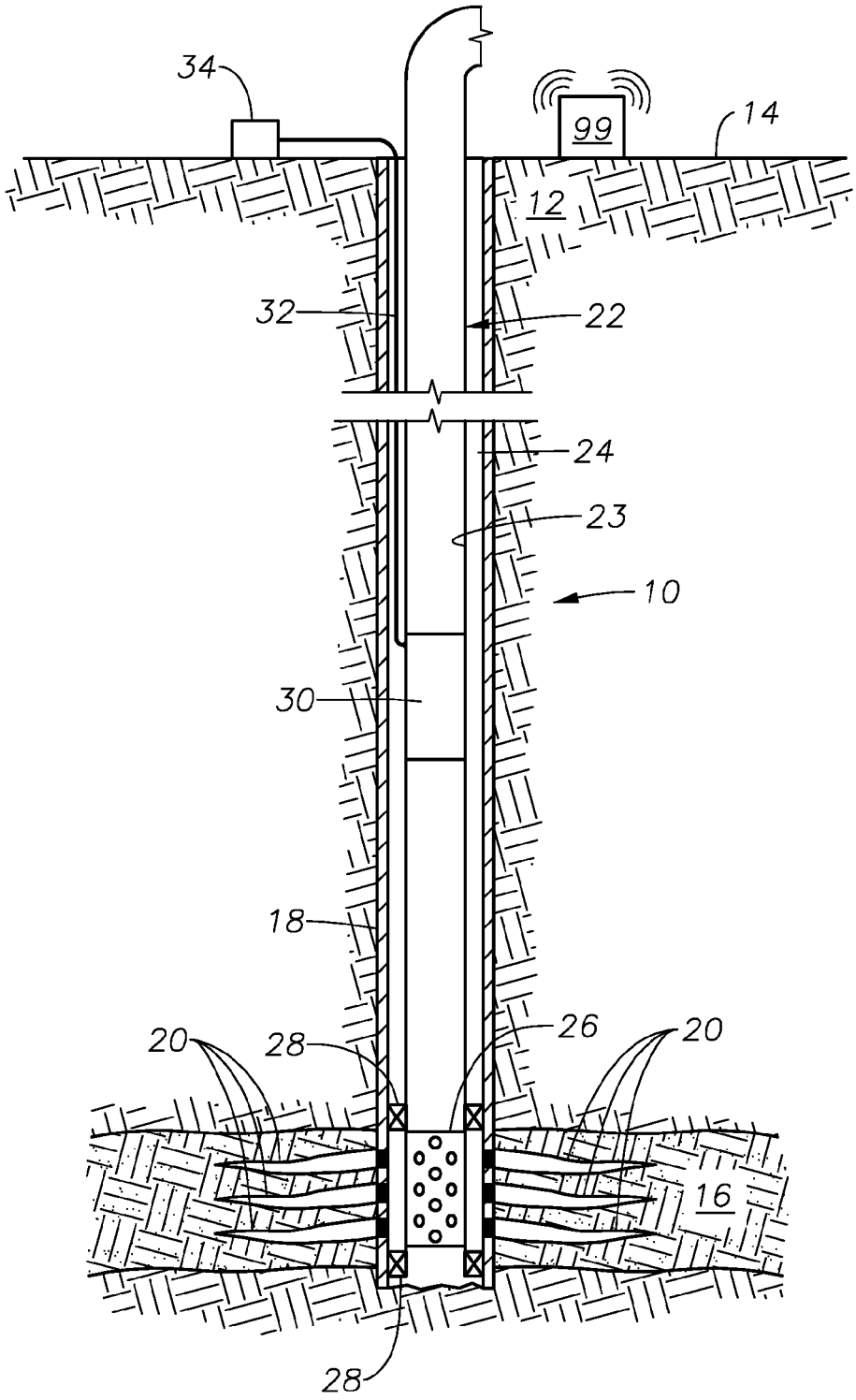
FIG. 1 is a side, partial cross-sectional view of an exemplary wellbore containing a production string with subsurface safety valves constructed in accordance with the present invention.

FIG. 1 illustrates an exemplary wellbore 10 that has been disposed within the earth 12 from the surface 14 and down to a hydrocarbon-bearing formation 16 from which it is desired to obtain hydrocarbon production fluid. The wellbore 10 is lined with metallic casing 18 in a manner known in the art. Perforations 20 are formed through the casing 18 and into the formation 16.

A production tubing string 22 is disposed within the wellbore 10, and an annulus 24 is formed between the production tubing string 22 and the casing 18. A central axial flowbore 23 is defined along the length of the production tubing string 22 for flow of fluids therethrough. The production tubing string 22 may be made up of a number of threaded production tubing string segments, in a manner known in the art. Alternatively, the production tubing string 22 may be formed of coiled tubing. The production tubing string 22 includes a ported production nipple 26, of a type known in the art, which is located within the wellbore 10 proximate the perforations 20. Packers 28 isolate the production nipple 26 within the wellbore 10.

The production tubing string 22 also includes an electrically-powered tubing-retrievable safety valve assembly (TRSV) 30 above the production nipple 26. An electrical power supply cable 32 extends from the valve assembly 30 to the surface 14 wherein it is operably associated with a power source 34. The safety valve assembly 30 is preferably a flapper-type safety valve which is operable between open and closed positions to selectively block fluid flow through the production tubing string 22. The TRSV 30 includes a tubular outer housing 36 which defines a central axial valve bore 38 which is aligned with the flowbore 23 of the production tubing string 22. The valve bore 38 contains a landing profile 40. In addition, seal bores 42, 44 are located within the valve bore 38. The seal bores 42, 44 are smooth bore portions that for packing stacks of seals on a component disposed inside the valve bore 38 to seal against the seal bores 42, 44.

Figure 2:
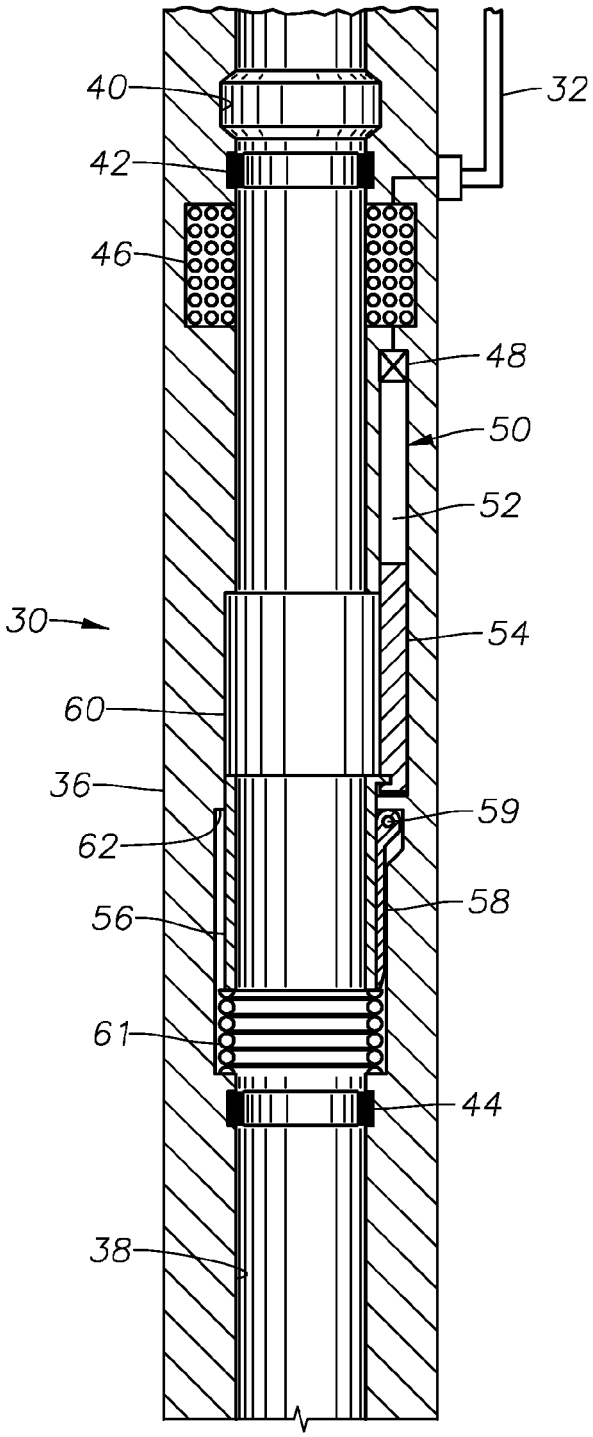
FIG. 2 is a side, cross-sectional view of an exemplary tubing-retrievable safety valve, in accordance with the present invention, with the valve in an open configuration.
Figure 3:
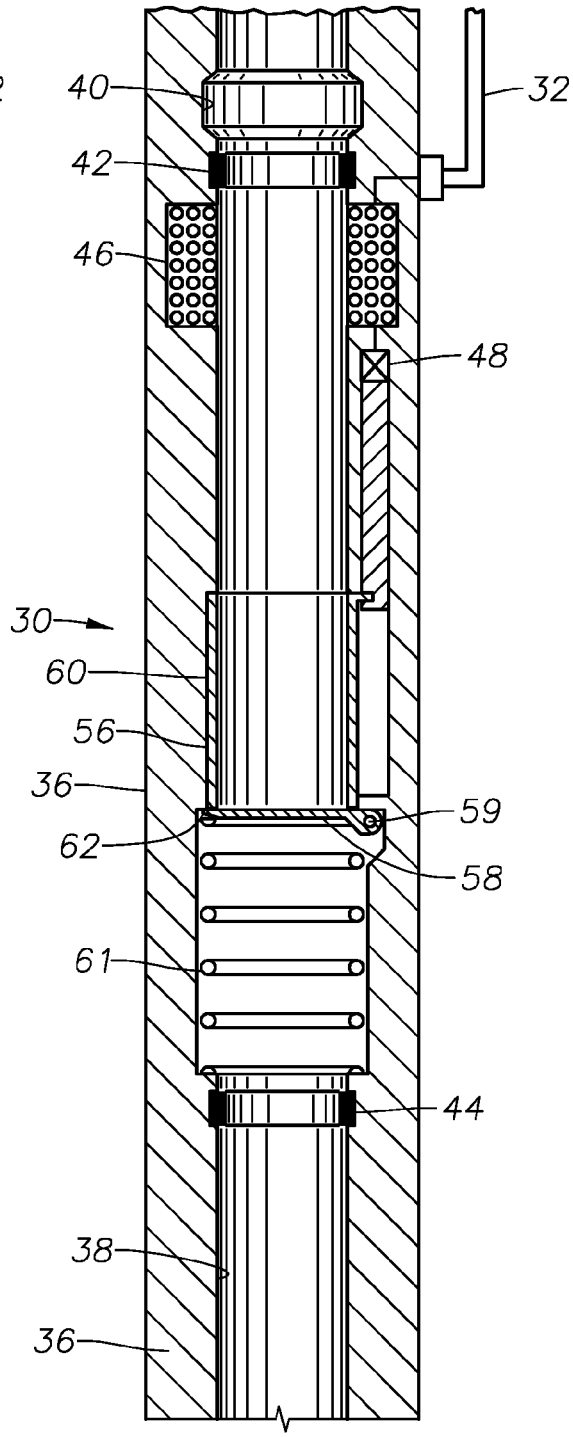
FIG. 3 is a side, cross-sectional view of the tubing-retrievable safety valve shown in FIG. 2, now in a closed configuration.

The housing 36 of the valve assembly 30 includes an induction charging coil 46 which is preferably fully enclosed within the housing 36 and separated from the valve bore 38. The induction charging coil 46 is operably associated with the power supply cable 32 so that the coil 46 may be energized from the surface 14. The power supply cable 32 is also operably associated with a flapper valve actuator, which is depicted schematically at 48. The valve actuator 48 is interconnected with valve piston assembly 50. The valve piston assembly 50 includes a piston cylinder 52 and a piston member 54 that is movably disposed within the cylinder 52. The piston member 54 is interconnected with a flow tube 56 which controls the position of pivotable flapper member 58, in a manner known in the art. The flapper member 58 is a known device which is moveable about pivot point 59 between an open position, illustrated in FIG. 2, wherein fluid may pass through the valve bore 38, and a closed position, illustrated in FIG. 3, wherein fluid flow through the valve bore 38 is blocked by the flapper member 58. As is known, the flapper member 58 is biased by a torsional spring toward the closed position. The flow tube 56 is moveably disposed within a radially enlarged bore portion 60 of the valve bore 38. The flow tube 56 is biased toward the closed position by a compressible power spring 61, of a type known in the art. This spring bias provides for the valve assembly 30 to have a fail-safe mode such that, in the event of loss of a control signal from the surface (e.g., an electrical signal via cable 32), the power spring 61 will lift the flow tube 56 (see FIG. 3) and allow the flapper member 58 to rotate to its closed position. When the flow tube 56 is in a lowered position within the bore portion 60, as depicted in FIG. 2, the flow tube 56 retains the flapper member 58 in the open position. When the flow tube 56 is moved to an upper position within the bore portion 60, the flapper member 58 moves to its closed position against valve member seat 62, as depicted in FIG. 3. The flapper valve actuator 48 may be a fluid pump, a motor, an electromagnetic solenoid, or an electro-hydraulic actuator device which is operable to cause movement of the piston member 54 within the piston cylinder 52. One suitable electro-hydraulic valve actuator is described in U.S. Pat. No. 6,269,874 issued to Rawson et al. U.S. Pat. No. 6,269,874 is owned by the assignee of the present invention and is hereby incorporated in its entirety by reference.

Figure 4:
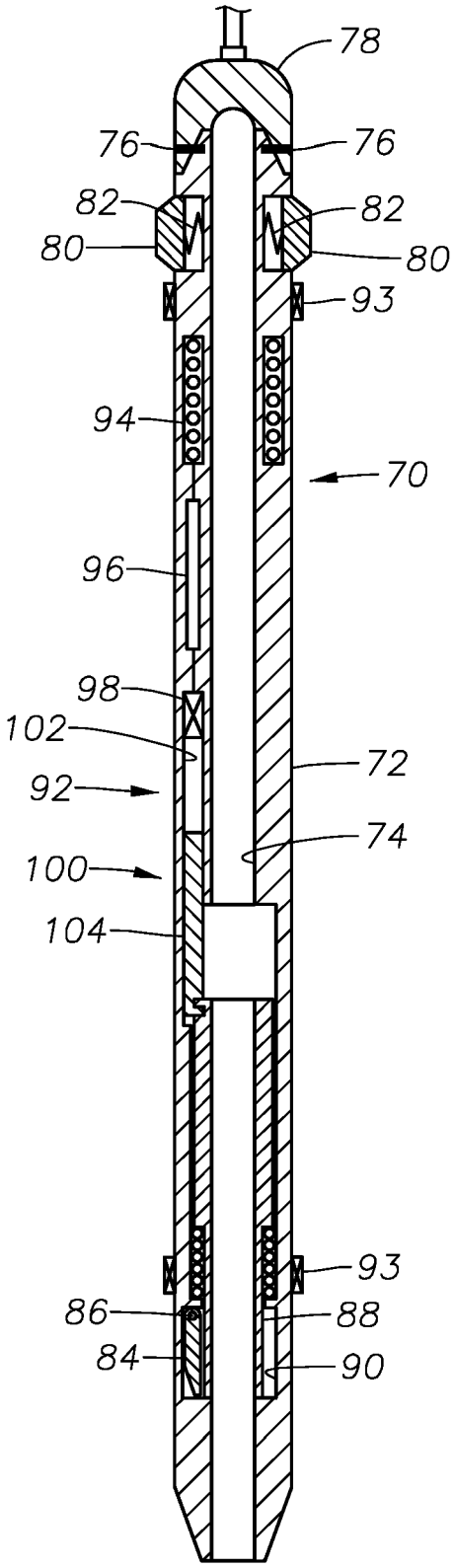
FIG. 4 is a side, cross-sectional view of an exemplary wireline insert safety valve constructed in accordance with the present invention.
Figure 4A:
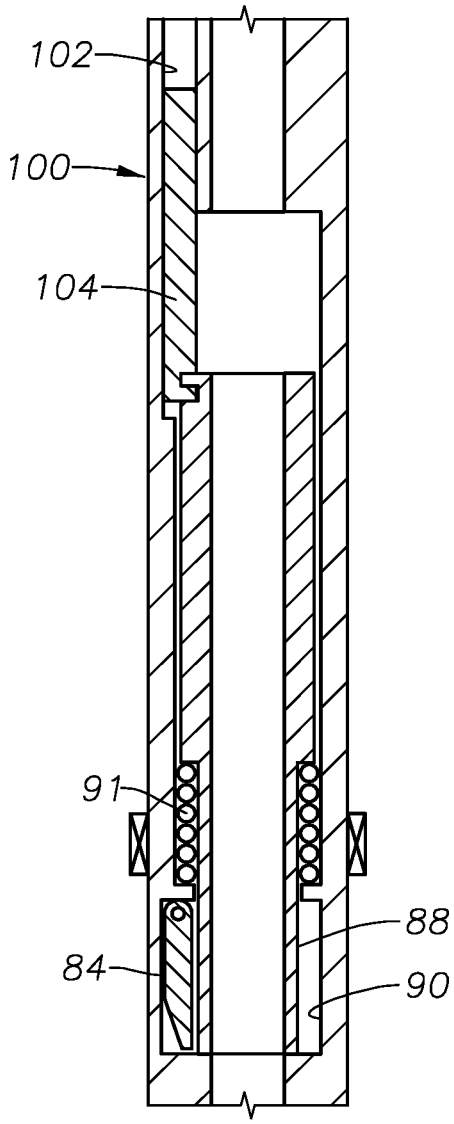
FIG. 4*a* is an enlarged side cross-sectional view of portions of the wireline insert safety valve shown in FIG. 4.

FIG. 4 illustrates an exemplary wireline insert safety valve 70 which is insertable into the production tubing string 22 and securable within the tubing run safety valve 30 in the event that the tubing-run safety valve 30 fails to operate. The wireline insert safety valve 70 includes a tubular valve housing 72 which is shaped and sized to fit within the valve bore 38 of the tubing run safety valve 30. An axial flowbore 74 is defined along the length of the valve housing 72. The valve housing 72 is secured by release pins 76 to a wireline running tool 78. The housing 72 carries a plurality of latching keys 80 which are biased radially outwardly by compression-springs 82. A flapper member 84 is also located within the flowbore 74 and is pivotable about pivot point 86 between open and closed positions within the flowbore 74. As with the flapper member 58, the flapper member 84 is biased toward a closed position by a torsional hinge spring. An axially moveable flow tube 88 is retained within a radially enlarged portion 90 of the flowbore 74. The flow tube 88 is spring-biased by an axially compressible power spring 91 (see FIG. 4*a*) toward a position that would lift the flow tube 88 and allow the flapper member 84 to be closed. The flow tube 88 serves the same purpose in controlling the flapper member 84 as the flow tube 56 does in controlling the configuration of the flapper member 58. A pair of external fluid seals 93 radially surrounds the valve housing 72 (see FIG. 4).

An electric flapper member actuating assembly, generally indicated at 92, is preferably housed within the housing 72 of the valve 70. The flapper member actuating assembly 92 includes an induction charging coil 94 which is preferably sealed within the housing 72 so as to not be in contact with either the flowbore 74 or the radial outer surface of the tool 70. The induction charging coil 94 is operably interconnected with a charge storage device 96, such as a rechargeable battery. The charge storage device 96 is operably interconnected with a valve actuator, shown schematically at 98. In an alternative embodiment, the coil 94 is directly connected with the valve actuator 98 such that energizing the coil 94 will cause the valve actuator 98 to be operated. In one preferred embodiment, the valve actuator 98 also includes a wireless receiver that is operable to receive a wireless signal from a surface-based wireless transmitter 99 and, in response to receipt of such a signal, will generate a command to actuate the associated valve piston assembly 100. The valve actuator 98 is interconnected with valve piston assembly 100. The valve piston assembly 100 includes a piston cylinder 102 and a piston member 104 that is movably disposed within the cylinder 102. The piston member 104 is interconnected with the flow tube 88 which controls the position of pivotable flapper member 84. When the valve actuator 98 is actuated, the spring bias provided by the power spring 91 is overcome by the actuator 98. The valve actuator 98 may be a fluid pump, a motor, an electromechanical solenoid, or an electro-hydraulic actuator device which is operable to cause movement of the piston member 104 within the piston cylinder 102. Upon loss of power to the valve actuator 98, the valve member 84 will be closed due to the fail-safe spring bias of the power spring 91.

Figure 5:
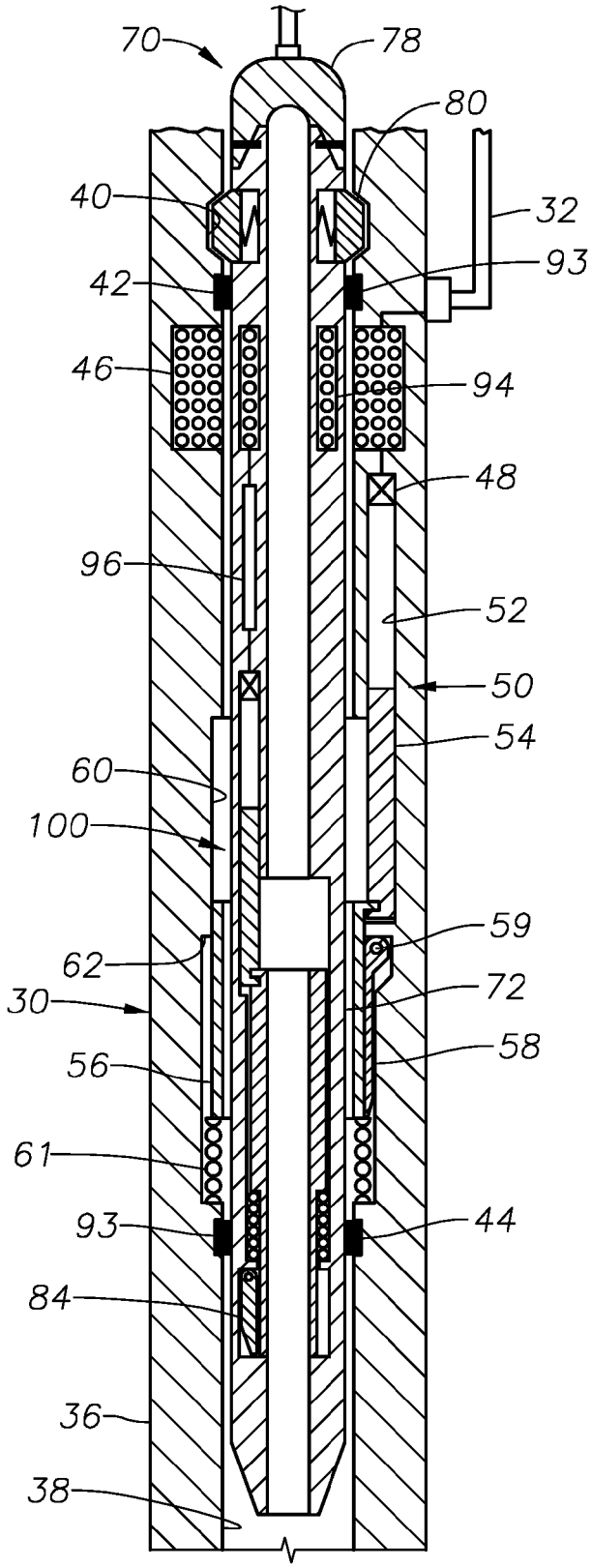
FIG. 5 is a side, cross-sectional view of the wireline insert safety valve inserted within the tubing-retrievable safety valve.

FIG. 5 depicts the WLSV 70 landed securely within the valve bore 38 of the TRSV 30 so that the keys 80 of the WLSV 70 are latched into the landing profile 40 of the radially surrounding TRSV 30. When the keys 80 are latched into the landing profile 40, the induction charging coil 94 of the WLSV 70 is in proximity to the induction charging coil 46 of the TRSV 30 such that electrical energy can be effectively transferred from the coil 46 to the coil 94 via induction charging. It can be seen from FIG. 5 that, when the wireline insert valve 70 is landed within the landing profile 40, the induction charging coil 94 of the WLSV 70 is preferably generally aligned with the induction charging coil 46 of the TRSV 30 to form an inductive coupling. Energizing the coil 46 of the TRSV 30 will cause the coil 94 to be energized via inductive charging. When the WLSV 70 is landed within the landing profile 40, the fluid seals 93 on the outer radial surface of the WLSV valve housing 72 form a seal against the seal bores 42, 44 of the TRSV 30.

In operation, the WLSV 70 may be used as a back-up valve in the event that the TRSV 30 fails to operate. When the TRSV 30 fails, the WLSV 70 is affixed to the wireline running tool 78 and is run into the tubing string 22. The WLSV 70 is lowered through the production tubing string 22 until the keys 80 of the WLSV 70 become latched into the landing profile 40. Following landing, electrical power is transmitted from the surface through the cable 32 to the induction coil 46 of the TRSV 30 to energize the coil 46. Via induction charging, electric charge is transmitted from the outer coil 46 to the induction charging coil 94 of the WLSV 70. The transmitted electrical charge is stored in the storage device 96 or, alternatively, used to directly retain the flapper member in the open position.

When a sufficient amount of electrical charge has been transmitted to the WLSV 70, the WLSV 70 may be selectively actuated to move the flapper member 84 between its open and closed positions. In one preferred embodiment, the WLSV 70 is run into the production tubing string 22 in the closed position. Once sufficient electrical charge has been transmitted to the induction charging coil 94, the valve actuator 98 causes the piston member 104 to be moved axially within the cylinder 102 so that the flow tube 88 is moved axially downwardly within the housing 72, resulting in the flapper member 84 being moved to the open position. In the event of a loss of power to the charging coil 94, the flapper member 84 would rotate to the closed position as the power spring 91 moves the flow tube 88 upwardly.

Use of the wireless transmitter 99 to operate the WLSV 70 is preferred when used in connection with a charge storage device 96. In this instance, the WLSV 70 would be again run into the production tubing string 22 in the closed position. Transmission of power from the surface to induction charging coil 94 will then store electrical charge within the storage device 96. When it is desired to open the WLSV 70, a wireless command is transmitted from the transmitter 99 to the valve actuator 98.

The WLSV 70 may alternatively be actuated to close the flapper member 84 by transmitting a wireless signal from the transmitter 99 to the valve actuator 98. The valve actuator 98 causes the piston member 104 to be moved axially within the cylinder 102. As the piston member 104 is moved within the cylinder 102, the flow tube 88 is moved axially upwardly with respect to the surrounding housing 72 to allow the flapper member 84 to rotate to its closed position, thereby blocking fluid flow through the flowbore 74 of the housing 72. Due to the seal formed between the seals 42, 44 of the TRSV 30 and the housing 72 of the WLSV 70, any fluid flow through the flowbore 38 of the TRSV 30 and production tubing string 22 is thereby blocked by the flapper member 84.

The TRSV 30 and WLSV 70 collectively form a safety valve arrangement that will allow the flowbore 23 of the production tubing string 22 to be selectively closed off to fluid flow even in the event that the TRSV 30 becomes inoperable and is no longer able to close off fluid flow through the flowbore 23.

The foregoing description is directed to particular embodiments of the present invention for the purpose of illustration and explanation. It will be apparent, however, to those skilled in the art that many modifications and changes to the embodiment set forth above are possible without departing from the scope and the spirit of the invention.

What is claimed is:

1. A safety valve assembly for selectively closing off and opening fluid flow through a flowbore of a wellbore, the safety valve assembly comprising:

a valve member that is moveable between an open position, wherein fluid flow is permitted through the flowbore and a closed position, wherein fluid flow through the flowbore is blocked by the valve member;

a valve actuator for moving the valve member between its open and closed positions;

an electrical power source powering the valve actuator; and an induction charging coil operably interconnected with the power source, the induction charging coil operable to receive electrical charge from an inductive coupling with a second induction charging coil.

2. The safety valve assembly of claim 1 wherein the valve member is a flapper valve member.

3. The safety valve assembly of claim 1 further comprising a valve housing having a latching mechanism for securing the safety valve assembly within the flowbore of the wellbore.

4. The safety valve assembly of claim 1 wherein the valve actuator comprises a fluid pump.

5. The safety valve assembly of claim 1 wherein the valve actuator comprises a solenoid.

6. The safety valve assembly of claim 1 wherein the valve actuator comprises a motor.

7. The safety valve assembly of claim 1 wherein the valve actuator comprises an electro-hydraulic actuator device.

8. The safety valve assembly of claim 1 wherein the valve actuator further comprises a wireless receiver to receive a wireless command signal from an external source and, in response thereto, move the valve member between the open and closed positions.

9. A safety valve arrangement for blocking fluid flow through a wellbore flowbore, the safety valve arrangement comprising:

a first safety valve assembly disposed within the flowbore and having a housing defining a valve bore and a first valve member that is moveable between open and closed positions to selectively block fluid flow through the valve bore;

the first safety valve assembly having a first induction coil that is selectively energizable with electrical energy;

a second safety valve assembly that is shaped and sized to be disposed within the valve bore of the first safety valve assembly, the second safety valve assembly comprising a second valve member that is moveable between open and closed positions to block fluid flow through the second safety valve assembly;

the second safety valve assembly having a second induction coil that is selectively energizable with electrical energy via induction coupling with the first induction coil, the second induction coil providing electrical power for moving the second valve member between its open and closed positions.

10. The safety valve arrangement of claim 9 wherein the second safety valve assembly comprises a charge storage device operably interconnected with the second induction coil for retaining electrical energy that has been transmitted to the second induction coil.

11. The safety valve arrangement of claim 9 wherein the second safety valve assembly comprises a latching mechanism for securing the safety valve assembly within the valve bore of the first safety valve assembly.

12. The safety valve arrangement of claim 9 further comprising an electrically-powered valve actuator within the second valve assembly to move the second valve member between its open and closed positions.

13. The safety valve arrangement of claim 12 wherein the valve actuator comprises a fluid pump.

14. The safety valve arrangement of claim 12 wherein the valve actuator comprises a motor.

15. The safety valve arrangement of claim 12 wherein the valve actuator comprises a solenoid.

16. The safety valve arrangement of claim 12 wherein the valve actuator comprises an electro-hydraulic actuator device.

17. A method of selectively blocking fluid flow within a production flowbore within a well, the method comprising the steps of:

disposing a first safety valve assembly within the flowbore, the first safety valve assembly having a valve member that is moveable between an open position, wherein fluid flow through the flowbore is permitted, and a closed position, wherein fluid flow through the flowbore is blocked;

operating the first safety valve assembly to selectively block the flowbore until the first safety valve assembly fails to move between the open and closed positions;

disposing a second safety valve assembly into the flowbore, the second safety valve assembly having an electrically-powered valve member that is operable between an open position, wherein fluid flow through the flowbore is permitted, and a closed position, wherein fluid flow through the flowbore is blocked;

transmitting electrical power from the first safety valve assembly to the second safety valve assembly via induction charging for operation of the valve member of the second safety valve assembly; and operating the second safety valve assembly to selectively block fluid flow through the flowbore.

18. The method of claim 17 wherein the step of transmitting electrical power from the first safety valve assembly to the second safety valve assembly comprises:

forming an inductive coupling between a first induction charging coil associated with the first safety valve assembly and a second induction charging coil associated with the second safety valve assembly; and energizing the first induction charging coil with electrical energy to transmit electrical energy from the first induction charging coil to the second induction charging coil.

19. The method of claim 17 wherein the step of operating the second safety valve assembly further comprises providing a command signal for actuation of the valve member of the second safety valve assembly via wireless transmission.

* * * * *